US008695221B2

(12) United States Patent
Hao

(10) Patent No.: US 8,695,221 B2
(45) Date of Patent: Apr. 15, 2014

(54) UTILITY KNIFE WITH EXTENDED TRAVEL CARRIAGE

(76) Inventor: Wen Hao, Industry, CA (US)

( * ) Notice: Subject to any disclaimer, the term of this patent is extended or adjusted under 35 U.S.C. 154(b) by 197 days.

(21) Appl. No.: 12/195,958

(22) Filed: Aug. 21, 2008

(65) Prior Publication Data

US 2010/0043235 A1 Feb. 25, 2010

(51) Int. Cl.
*B26B 3/06* (2006.01)

(52) U.S. Cl.
USPC ..... 30/151; 30/162; 30/337

(58) Field of Classification Search
USPC ..... 30/2, 293, 294, 151–164, 337
See application file for complete search history.

(56) References Cited

U.S. PATENT DOCUMENTS

| | | | |
|---|---|---|---|
| 493,075 | A | 3/1893 | Evertz |
| 515,045 | A | 2/1894 | Von Bultzingslowen |
| 705,441 | A | 7/1902 | Putney |
| 1,444,324 | A | 3/1919 | Brooks |
| 1,496,927 | A | 6/1924 | Evers |
| 1,500,550 | A | 7/1924 | D'Hont |
| 1,706,251 | A | 10/1927 | Perry |
| 1,753,441 | A | 4/1930 | Morehouse |
| 1,940,855 | A | 6/1931 | Friedman |
| 2,051,721 | A | 6/1935 | Kirangelos |
| 2,134,973 | A | 1/1938 | Harwell |
| 2,284,128 | A | 5/1939 | Bush |
| 2,265,775 | A | 12/1939 | McNamara |
| 2,523,575 | A | 4/1947 | Kassel |
| 2,569,080 | A | 9/1951 | Trimble et al. |
| 2,599,439 | A | 6/1952 | Drake |
| 2,601,723 | A | 6/1952 | Keller |
| 2,605,545 | A | 8/1952 | Weems |
| 2,735,176 | A | 2/1953 | Costin |
| 2,632,244 | A | 3/1953 | Belsky |
| 2,914,850 | A | 10/1957 | Kunhl |
| 2,980,966 | A | 9/1958 | Praeg |
| 3,171,201 | A | 3/1965 | Carifi |
| 3,187,431 | A | 6/1965 | Irmgard |
| 3,192,624 | A | 7/1965 | Gringer |
| 3,234,649 | A | 2/1966 | Preble et al. |
| 3,306,297 | A | 2/1967 | Voorhees et al. |
| 3,577,637 | A | 5/1971 | Braginetz |

(Continued)

FOREIGN PATENT DOCUMENTS

| | | | |
|---|---|---|---|
| DE | 29819618 | 3/1999 | ..... B26B 5/00 |
| WO | WO2007/042001 | 4/2007 | ..... B26B 5/00 |

*Primary Examiner* — Omar Flores Sanchez
(74) *Attorney, Agent, or Firm* — Lackenbach Siegel, LLP; Myron Greenspan

(57) ABSTRACT

A utility knife has a handle generally defining a handle axis and a remote end provided with an opening. A carriage is slidably mounted within the handle for selective movements through the opening between a retracted position in which the carriage is substantially fully received within the handle and a fully extended position in which the carriage is fully extended through the opening to increase the effective length of said handle by a distance Δl. A blade mounted on the carriage shares the movements of the carriage and has an operative portion that can fully penetrate a work to be cut when the handle axis is inclined at an angle α relative to a surface of the work. A finger of a user most proximate to the work surface is positionable a distance h above the work surface during normal use of the utility knife, Δl and α being selected so that the distance Δl is generally greater that 1.0 inch and the angle α is equal to at least 35°.

18 Claims, 2 Drawing Sheets

(56) References Cited

U.S. PATENT DOCUMENTS 3,660,896 A 5/1972 Umholtz
3,683,496 A 8/1972 Johnson
3,708,881 A * 1/1973 Bennett ..... 30/320
3,845,554 A 11/1974 Joanis et al.
3,855,700 A 12/1974 Gerson et al.
3,872,591 A 3/1975 Quenot
3,879,847 A 4/1975 Roll
3,927,473 A 12/1975 Braginetz
3,943,627 A 3/1976 Stanley
3,964,162 A 6/1976 Gerson
3,999,290 A * 12/1976 Wood ..... 30/2
4,017,969 A 4/1977 Stonebraker
4,068,375 A 1/1978 Rathbun et al.
4,109,380 A 8/1978 Anderson
4,134,206 A 1/1979 Beerman
4,170,062 A 10/1979 Machida
4,180,908 A 1/1980 Beerman
4,209,900 A 7/1980 Gilbert
4,232,445 A 11/1980 Ito
4,233,737 A 11/1980 Poehlmann
4,242,795 A 1/1981 Rollband et al.
4,261,104 A 4/1981 Cuscovitch
4,292,738 A 10/1981 Osada
4,320,576 A 3/1982 Beerman
4,347,665 A 9/1982 Glesser
4,393,587 A 7/1983 Kloosterman
4,408,396 A 10/1983 Scholl
4,509,260 A 4/1985 Gringer
4,517,741 A 5/1985 Castelluzzo
4,524,518 A 6/1985 West
4,570,342 A 2/1986 Baum
4,575,940 A 3/1986 Wenzel
4,604,805 A 8/1986 Krieger
4,620,369 A 11/1986 Gercken
4,660,284 A 4/1987 Decarollis
4,662,070 A 5/1987 Reddig
4,663,845 A 5/1987 Weimann
4,713,885 A 12/1987 Keklak et al.
4,761,882 A 8/1988 Silverstein
4,813,132 A 3/1989 Castelluzo
4,835,865 A 6/1989 Knoop
4,837,931 A 6/1989 Beerman
4,884,307 A 12/1989 Flood
4,899,443 A 2/1990 Beermann
4,930,218 A 6/1990 Jacoff
4,936,014 A 6/1990 Shaanan et al.
4,939,839 A 7/1990 Gorst
5,031,322 A 7/1991 Jacoff
5,086,562 A 2/1992 Jacoff
5,095,624 A 3/1992 Ennis
5,201,748 A 4/1993 Newman et al.
5,203,085 A 4/1993 Berns
5,255,443 A 10/1993 Schmidt
D346,319 S 4/1994 Lavallee et al.
5,303,469 A 4/1994 Yin-Han
5,344,424 A 9/1994 Roberts et al.
5,384,963 A 1/1995 Beerman
5,386,632 A 2/1995 Schimidt
5,400,512 A 3/1995 Brush
5,406,707 A 4/1995 Owens et al.
5,433,004 A 7/1995 Thompson et al.
5,481,804 A 1/1996 Platts
5,495,670 A 3/1996 Quinn
5,502,896 A * 4/1996 Chen ..... 30/162
5,511,311 A 4/1996 Collins
5,513,405 A 5/1996 Bradbury et al.
5,581,890 A 12/1996 Schmidt
5,598,634 A 2/1997 Berns
5,603,162 A * 2/1997 Chen ..... 30/162
5,613,300 A 3/1997 Schimidt
5,617,635 A 4/1997 Berns
5,620,454 A * 4/1997 Pierce et al. ..... 606/167
5,647,132 A 7/1997 Berns
5,664,792 A 9/1997 Tseng
5,749,886 A 5/1998 Abidin et al.
5,806,189 A 9/1998 Bailey
5,813,121 A 9/1998 Gringer
5,864,954 A 2/1999 Harrington
5,870,828 A 2/1999 Polites
5,878,501 A 3/1999 Owens et al.
5,890,293 A 4/1999 Gamba
5,906,049 A 5/1999 Butts
5,906,050 A 5/1999 Gilbert
5,909,930 A 6/1999 Ragland et al.
5,940,970 A 8/1999 D'Ambro, Sr. et al.
5,966,816 A 10/1999 Roberson
5,966,817 A 10/1999 Lee
D420,270 S 2/2000 Martone
6,026,575 A 2/2000 Wonderley
6,070,326 A 6/2000 Berns
6,148,520 A 11/2000 Berns
6,161,290 A 12/2000 Takamasa
D437,767 S 2/2001 Van Deursen et al.
D438,084 S 2/2001 Khachatoorian
6,192,589 B1 2/2001 Martone et al.
D439,492 S 3/2001 Martone et al.
D440,858 S 4/2001 Gilbert
6,223,439 B1 5/2001 Wonderley
6,233,832 B1 5/2001 Berns
6,249,975 B1 6/2001 Lin
6,263,577 B1 7/2001 Wonderley
6,263,581 B1 7/2001 Forte
6,286,215 B1 9/2001 Panaccione
6,308,418 B1 10/2001 Sweet
6,314,646 B1 11/2001 Schmidt
6,330,749 B1 12/2001 Khachatoorian et al.
6,354,007 B1 3/2002 Scarla
6,357,120 B1 3/2002 Khachatoorian et al.
6,374,497 B1 4/2002 Sun
D458,526 S 6/2002 Budrow
6,415,514 B1 7/2002 Chun
6,418,624 B1 * 7/2002 Huang ..... 30/162
6,438,849 B1 8/2002 Wonderley
D462,250 S 9/2002 Ping
D463,639 S 9/2002 Panfili
6,442,784 B1 9/2002 Bilger
6,446,340 B1 9/2002 Ping
6,449,850 B1 9/2002 Gilbert
6,484,404 B1 * 11/2002 Kao ..... 30/162
6,502,311 B1 1/2003 Khachatoorian et al.
6,510,612 B1 1/2003 Cybulski
6,513,246 B2 2/2003 Ping
6,532,670 B1 3/2003 Berns
D473,778 S 4/2003 Hsu
6,543,140 B1 4/2003 Davis
6,546,632 B2 4/2003 Gilbert
6,550,144 B1 4/2003 Berns
6,553,674 B1 4/2003 Budrow
6,574,872 B2 6/2003 Roberts et al.
6,578,221 B2 6/2003 Ping
D478,493 S 8/2003 Martone et al.
6,645,216 B2 11/2003 Masury et al.
6,678,958 B1 1/2004 Budrow
6,688,003 B2 2/2004 Scarla
6,718,637 B1 4/2004 Ortner et al.
6,735,872 B1 5/2004 Chang
D492,179 S 6/2004 Hernandez et al.
6,742,260 B1 6/2004 Hsu
6,742,261 B2 6/2004 Ho
D495,939 S 9/2004 Ping
6,785,966 B2 9/2004 Berns
6,796,033 B2 9/2004 Owoc
6,802,126 B2 10/2004 Huang
6,829,827 B2 12/2004 Tseng
6,832,438 B1 12/2004 Gringer et al.
D501,782 S 2/2005 Ping
6,848,185 B2 2/2005 Tebo
D502,379 S 3/2005 Tseng
6,874,188 B2 4/2005 Johnson et al.
6,898,855 B2 5/2005 Jones et al.
6,907,668 B2 6/2005 Polei
6,915,577 B2 7/2005 Scala
D509,419 S 9/2005 Chung
D509,724 S 9/2005 Cook

(56) References Cited

U.S. PATENT DOCUMENTS

| | | | | |
|---|---|---|---|---|
| 6,948,250 | B1 | 9/2005 | Calafa et al. | |
| D510,250 | S | 10/2005 | Ping | |
| 6,951,055 | B1 | 10/2005 | Collins | |
| 6,957,491 | B2 | 10/2005 | Van Deursen et al. | |
| 6,966,113 | B2 | 11/2005 | Fossella | |
| 6,968,622 | B2 | 11/2005 | Ping | |
| D512,296 | S | 12/2005 | Ping | |
| 6,971,178 | B2 | 12/2005 | Rowlay | |
| D516,403 | S | 3/2006 | Ping | |
| D517,893 | S | 3/2006 | Ping | |
| 7,007,392 | B2 | 3/2006 | Ping | |
| D519,019 | S | 4/2006 | Ping | |
| 7,028,406 | B2 | 4/2006 | Polei | |
| 7,040,022 | B2 | 5/2006 | Ping | |
| 7,051,443 | B2 | 5/2006 | Mueller | |
| D522,835 | S | 6/2006 | Ping | |
| 7,055,407 | B2 | 6/2006 | Gringer et al. | |
| D524,138 | S | 7/2006 | Chin | |
| D525,104 | S | 7/2006 | Samberg | |
| D526,877 | S | 8/2006 | Ping | |
| D526,878 | S | 8/2006 | Ping | |
| D528,895 | S | 9/2006 | Ping | |
| 7,107,688 | B1 | 9/2006 | Critelli et al. | |
| 7,134,207 | B2 * | 11/2006 | Ping | 30/125 |
| 7,146,736 | B1 * | 12/2006 | Collins | 30/160 |
| D535,171 | S | 1/2007 | Ping | |
| 7,185,435 | B1 | 3/2007 | Tseng | |
| 7,194,809 | B2 | 3/2007 | Skluzak | |
| D539,628 | S | 4/2007 | Ping | |
| D543,822 | S | 6/2007 | Ping | |
| D545,165 | S | 6/2007 | Ping | |
| D551,050 | S | 9/2007 | Ping | |
| D552,955 | S | 10/2007 | Ping | |
| 7,296,354 | B2 | 11/2007 | Van Deursen et al. | |
| D558,555 | S | 1/2008 | Huang | |
| D559,072 | S | 1/2008 | Fraga | |
| 7,316,070 | B2 | 1/2008 | Green | |
| 7,322,110 | B2 | 1/2008 | Hernandez | |
| 7,325,313 | B2 | 2/2008 | Gringer et al. | |
| D564,327 | S | 3/2008 | Wu | |
| 7,448,136 | B2 | 11/2008 | Huang | |
| 7,475,480 | B2 | 1/2009 | Votolato | |
| 2002/0029480 | A1 | 3/2002 | Lin | |
| 2002/0096032 | A1 | 7/2002 | Peyrot et al. | |
| 2002/0144407 | A1 | 10/2002 | Gilbert | |
| 2002/0162229 | A1 | 11/2002 | Roberts et al. | |
| 2003/0037444 | A1 | 2/2003 | Chunn | |
| 2003/0079294 | A1 | 5/2003 | Deursen et al. | |
| 2003/0079347 | A1 * | 5/2003 | Davis | 30/2 |
| 2003/0150116 | A1 | 8/2003 | Scala | |
| 2003/0154605 | A1 | 8/2003 | Chao | |
| 2003/0159290 | A1 | 8/2003 | Berns | |
| 2004/0040159 | A1 | 3/2004 | Fossella | |
| 2004/0045172 | A1 | 3/2004 | Rowlay | |
| 2004/0107580 | A1 | 6/2004 | Ping | |
| 2004/0139614 | A1 | 7/2004 | Tebo | |
| 2004/0173650 | A1 | 9/2004 | Berns | |
| 2004/0226173 | A1 | 11/2004 | Ping | |
| 2004/0226175 | A1 | 11/2004 | Ping | |
| 2004/0237312 | A1 | 12/2004 | Hernandez et al. | |
| 2004/0250426 | A1 | 12/2004 | Polei | |
| 2005/0055833 | A1 | 3/2005 | Scarla | |
| 2005/0138816 | A1 | 6/2005 | Ping | |
| 2005/0155226 | A1 | 7/2005 | Van Deursen et al. | |
| 2005/0188541 | A1 | 9/2005 | Brown et al. | |
| 2005/0193566 | A1 | 9/2005 | Brown | |
| 2005/0193567 | A1 | 9/2005 | Ho | |
| 2005/0193568 | A1 | 9/2005 | Peyrot | |
| 2005/0204567 | A1 | 9/2005 | Ping | |
| 2005/0235499 | A1 | 10/2005 | Van Deursen et al. | |
| 2005/0278955 | A1 * | 12/2005 | Lee | 30/153 |
| 2005/0283983 | A1 | 12/2005 | Huang | |
| 2006/0026844 | A1 | 2/2006 | Ping | |
| 2006/0059693 | A1 | 3/2006 | Fossella | |
| 2006/0137190 | A1 | 6/2006 | Deursen et al. | |
| 2006/0242841 | A1 | 11/2006 | Fossella | |
| 2007/0006466 | A1 | 1/2007 | Ping | |
| 2007/0011882 | A1 | 1/2007 | Ping | |
| 2007/0028454 | A1 | 2/2007 | Ranieri et al. | |
| 2007/0028455 | A1 | 2/2007 | Ranieri et al. | |
| 2007/0068003 | A1 | 3/2007 | Schimdt | |
| 2007/0074402 | A1 | 4/2007 | Hernandez | |
| 2007/0107233 | A1 | 5/2007 | Polei | |
| 2007/0119056 | A1 | 5/2007 | Polei | |
| 2007/0130777 | A1 | 6/2007 | Ping | |
| 2007/0130779 | A1 | 6/2007 | Tatum | |
| 2007/0157472 | A1 | 7/2007 | Critelli | |
| 2008/0110028 | A1 | 5/2008 | Seber | |
| 2008/0141539 | A1 | 6/2008 | Co | |
| 2008/0189956 | A1 | 8/2008 | Polei | |
| 2008/0282546 | A2 | 11/2008 | Ranieri | |
| 2009/0271990 | A1 * | 11/2009 | De | 30/162 |

* cited by examiner

UTILITY KNIFE WITH EXTENDED TRAVEL CARRIAGE

BACKGROUND OF THE INVENTION

1. Field of the Invention

This invention and generally relates to hand tools, and, more specifically, to a utility knife with an extended travel carriage.

2. Description of the Prior Art

Utility knives have long been used for cutting generally thin works such as the cardboard, fabrics, sheets of plastic materials and thin strips of wood. Such knives, however, have generally been large and a bulky. Numerous designs have been proposed to render utility knives generally thinner and shorter along in the axial length of the handles to make the units portable and more comfortable to hold. However, a problem with utility knives that have short handles is that when only a small portion of the blade is extended from the handle and that portion of the blade is fully inserted through or penetrates the work to be cut at least the lowermost finger of the user, most proximate to the upper surface of the work to be cut, can be positioned very close to the material being cut. If the utility knife handle is not held at the proper angle or the normal or recommended angle of inclination is decreased the lowermost finger of the user can contact the surface being cut and the finger can be injured as it is moved over the upper surface of the material, particularly if in the upper surface of the material is not smooth but somewhat abrasive.

To overcome the above-mentioned problem some utility knife designs have used shorter handles in conjunction with an internal blade-carrying carriage that can be fully retracted within the handle so that both of the carriage and the cutting portion of the blade are fully contained within the handle when not in use. When the unit is to be used, the carriage is extended beyond the remote end of the handle to effectively increase the overall length of the handle so that when the utility knife handle is held at a designated angle relative to the work the lowermost finger is elevated above the work surface in an effect to avoid injury to the finger(s).

A utility knife of the general type under discussion is described in the U.S. patent application Ser. No. 12/114,234, assigned to the assignee of the subject application, which application is incorporated by reference as if fully set forth herein.

Referring to FIG. 1, a prior art utility knife is illustrated in which a handle 12 defines a handle axis A. The handle has a leading or remote end, 12*x* that forms a positive angle α with the axis A so that the upper edge or surface 12*y* of the handle 12 is shorter than the lower edge or surface 12*z*. The utility knife 12 has a lateral slot S through which an actuating button B can be moved forwardly and rearwardly to move a carriage 14 to an extended or retracted position, respectively. In FIG. 1, the carriage 14 is shown in its extended position with a blade 16 removably mounted thereon for penetration through a work 18. Initially, the position of the button B on the side of the handle requires a two hand operation for moving the button B and the carriage. Additionally, because the button B is located at a position intermediate the upper and lower surfaces or edges 12*y* and 12*z* the extent of travel of the button B and, therefore, the carriage 16, is limited. Also, because of such limited travel, the closed or retracted length of the overall tool is 4.3125 inches while the open or extended length is 5.6875 inches. The change in length, therefore, or incremental length Δl, is 1.375 inches, or the percentage of incremental length is approximately 31.88%. With such a handle and a limited incremental length change when the blade is extended, the height "h" of the lowermost finger F above the upper surface 18*a* is approximately 0.97 in. when the angle α is selected to be approximately 45° during normal use.

For purposes of this application the height of the finger F above the work surface 18*a* is the distance between the work surface 18*a* and approximately the center or central axis $A_f$ of the finger.

SUMMARY OF THE INVENTION

Accordingly, it is an object to the invention to provide a utility knife that does not have the disadvantages of comparable prior art utility knives.

It is another object of the invention to provide a utility knife that is simple in construction and economical to manufacture.

It is still another object of the invention to provide a utility knife that is convenient to use.

It is yet another object of the invention to provide a utility knife that is ergonomically configured and comfortable to use.

It is further object of the invention to provide a utility knife of the general type under discussion that is mounted for extended travel externally of the handle when moved to its operative extended position to position the fingers of the user at a safer distance from the work being cut to prevent injury to the user.

It is still a further object of the invention to provide a utility knife, as in the previous object, in which an actuating button for extending and retracting the carriage is arranged on the handle for maximum sliding movements to optimize the extent of the travel of the carriage when it is extended outside the handle.

It is yet a further object of the invention to provide a utility knife, as in previous object, that positions the fingers of the user at a safe distance above the work surface even when the utility knife reasonably deviates from the optimum angular position during normal use.

In order to achieve the above objects, as well as others that will become apparent hereafter, a utility knife in accordance with the invention has a generally short handle defining a handle axis and a remote end provided with an opening. A carriage is mounted within the handle for movements through the opening between a retracted position in which the carriage is substantially fully received within the handle and a fully extended position in which the carriage is fully extended through the opening to increase the effective length of the handle by an incremental length Δl. A blade is mounted on the carriage for sharing the movements of the carriage and has an operative portion that can fully penetrate a work to be cut when the handle axis is inclined at an angle α relative to a work surface, a finger of a user most proximate to the work surface being positioned the distance "h" above the work surface during the normal use of the utility knife. The quantities Δl and α are selected so that the distance "h" is generally equal to at least 1.0 inch.

BRIEF DESCRIPTION OF THE DRAWINGS

The above and other objects, features and advantages of the present invention will be better understood from the following specification when read in conjunction with the accompanying drawings.

DETAILED DESCRIPTION OF THE DRAWINGS

Figure 1:
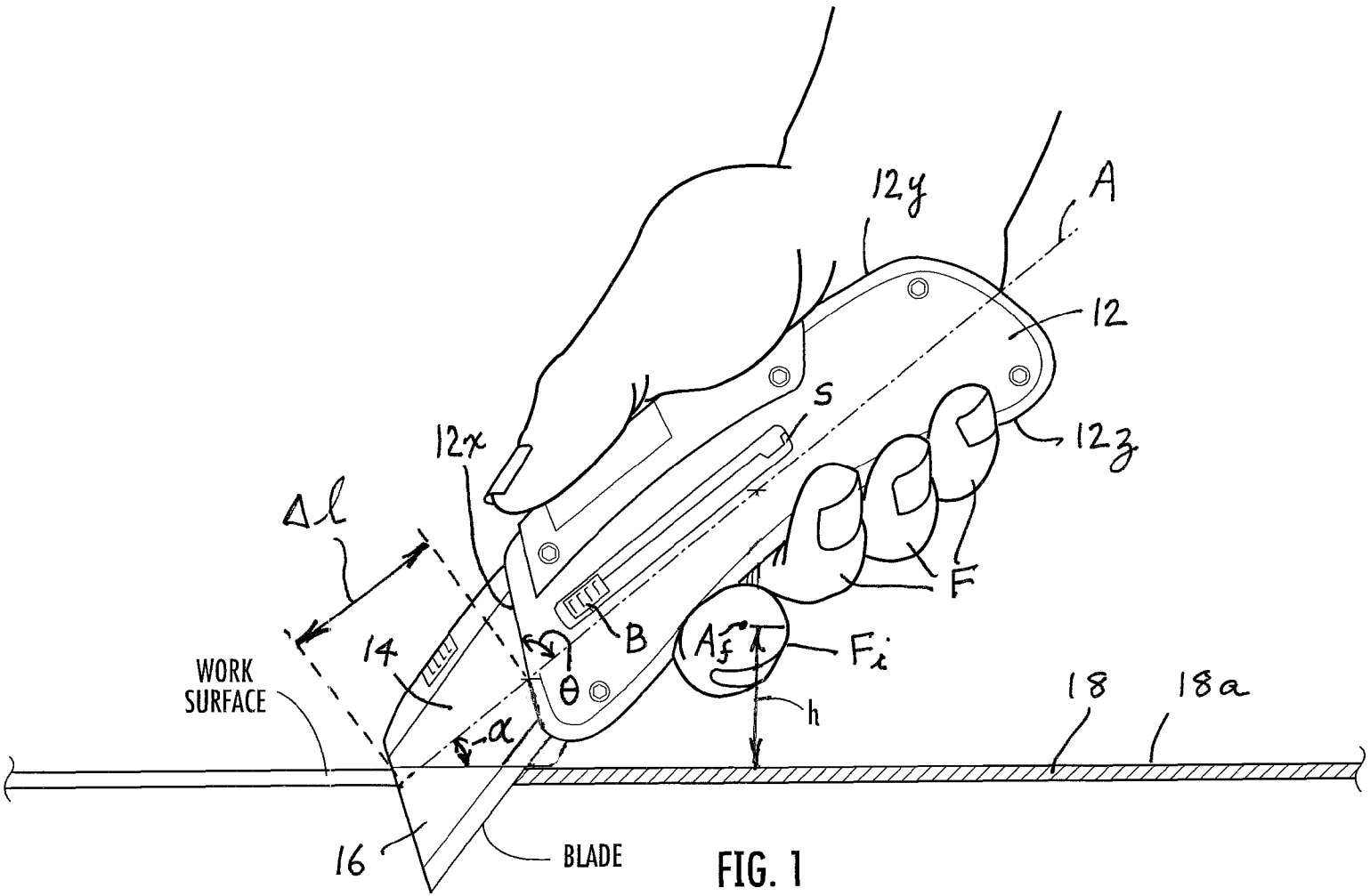
FIG. 1 (PRIOR ART)
FIG. 1 is a side elevational view of a prior art utility knife, indicating the proximity of the lowermost or pointing index finger to the upper surface of the work to be cut during normal use.
Figure 2:
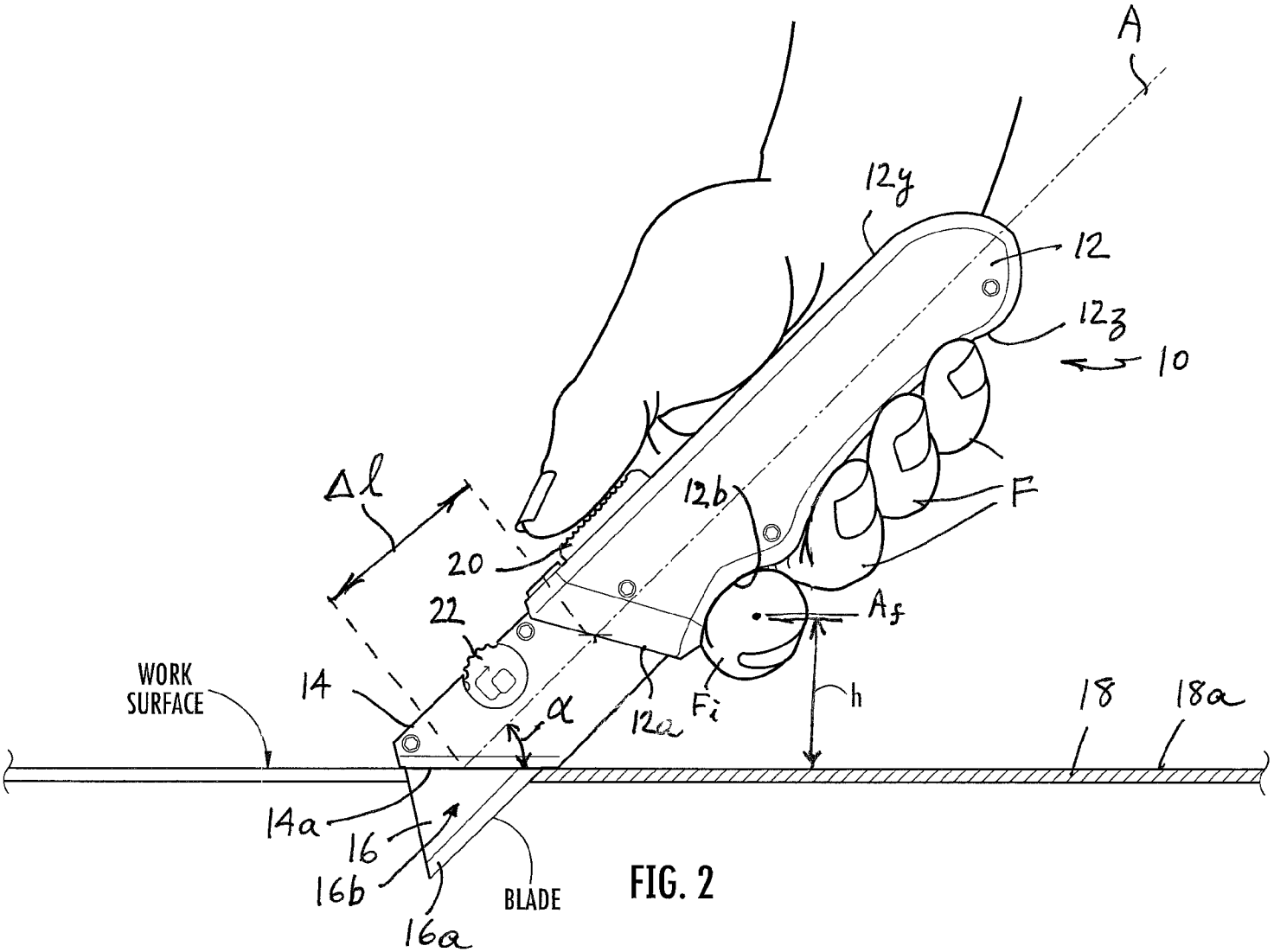
FIG. 2 is a side elevational view similar to FIG. 1 of a utility knife in accordance with the present invention in which the carriage has an extended travel to effectively lift or raise the lowermost or pointing or index finger above the surface of the work to avoid scraping or other injury to the finger.

Referring now specifically to FIG. 2, a utility knife in accordance with the invention is generally designated by the reference numeral 10.

The utility knife 10 has a handle 12 typically formed of two similar clam shells that are secured to one another in any conventional way to create an internal cavity. The handle 12 has an axis A that extends along the longitudinal length direction of the handle 12.

Mounted within the handle 12 is a carriage 14 that removably supports a blade 16 that has a cutting edge 16*a* as shown. The carriage 14 extends along the axis A and has an inclined remote end 14*a* that generally forms an angle α with the axis A. The inclined remote end 14*a* is generally parallel to a remote edge 12*a* of the handle. The blade 16 is removably mounted to the carriage 14 to expose a generally triangular operative portion 16*b* of the blade that can be inserted into the work 18 to penetrate through the work for cutting purposes. The remote edge 14*a* of the carriage serves as a guide to a user to position the handle 12 at a desired angle α by maintaining the edge 14*a* generally coextensive with the upper surface 18*a* the work 18 that faces the handle 12.

A button or actuating element 20 is arranged along the upper edge or surface 12*y* of the handle and is connected or linked to the carriage 14 so that the carriage shares the movements of the button 20 as the button is actuated by the thumb of a user for single-handed operation. The connection is through a slot (not shown) in the upper edge or surface 12*y* of the handle 12, in a manner disclosed in co-pending U.S. patent application Ser. No. 12/114,234, which is incorporated by reference as if fully set forth herein.

The lower surface or the edge on the handle 12 is preferably provided with a series of indentations 12*b* that serve as recesses for partially receiving the fingers F. The indentations 12*b* not only make the handle more ergonomic and more comfortable to hold but also serve to partially receive portions of the fingers to effectively elevate them further above the work surface 18*a*.

The blade 16 can be released and removed from the carriage by rotating a release element or disk 22 with the thumb of the user, as more fully described in the aforementioned co-pending application.

It will be appreciated that with an extended travel carriage 14 the increased length Δl causes the lowermost or index finger $F_i$ to be raised further above the work 18 when the handle is held at or close to the desired angle α, providing increased comfort and safety to the user by preventing the index finger of the user from touching or scraping the surface 18*a*.

An example of a utility knife according to the present invention has an overall length of 4.5 inches when the carriage is in a fully retracted position and 6.1875 inches in an extended position. The incremental change in length Δl, therefore, is 1.6875 inches, for a percentage increase in length of approximately 37.5 percent. In accordance with the invention the quantity Δl is equal to a greater than 1.4 inches and preferably greater than or equal 1.5 inches. In accordance with a presently preferred embodiment Δl is within the range of 1.6 to 1.7 inches. The angle α is preferably selected to be a equal to or greater than 35° and, preferably the angle α is selected to be within the range of 40-50°. In accordance with the presently preferred embodiment illustrated in FIG. 2 the angle α is approximately equal to 45°.

As indicated, the handle has upper and lower surfaces or edges 12*y*, 12*z*, the actuating button or member 20 being coupled to the carriage 14 and movable between the proximate and remote positions of the handle so that the carriage moves between the retracted and extended positions.

As suggested, the lower surface of the handle 12 is preferably provided with a series of recesses or indentations 12*b* arranged to at least partially receive the fingers of the user to effectively increase the distance "h" of the lowermost or index finger $F_i$ above the upper surface of the work to be cut. As shown in FIG. 2, the lowermost recess indentation closest to the remote end of the handle is deeper than the remaining recesses along the lower surface to further elevate or raise that finger $F_i$ and make the handle 12 more ergonomic and comfortable to the user. The dimensions Δl and α are selected so that h is generally equal to at least 1.0 inch.

A guide edge 14*a* of the carriage is arranged at the angle α with the guide edge positioned coextensively with a work surface of the work to maximize penetration while assist the user in maintaining the handle at the proper and safe angle α.

While the invention has been shown and described in connection with a preferred form of an embodiment it will be understood that modifications may be made without the departure from the scope or spirit of the invention.

The release element or disk 22 is provided on the carriage 14 for selectively releasing or locking the blade 16. The disk 22 is arranged generally in-line or coextensively along the upper edge 12*y* of the handle to allow a user to selectively operate both the button 20 or the disk 22 with one handed operation by placing the user's thumb either on the button 20 or the disk 22 when the carriage is in the extended position and while holding the handle 12.

What is claimed is:

1. Utility knife comprising:

a handle having an upper edge and defining a handle axis generally parallel to said upper edge and a remote end provided with an opening;

a carriage slidably mounted within said handle for movements through said opening between a retracted position, in which said carriage is substantially fully received within said handle, and a fully extended position, in which said carriage is fully extended through said opening to increase the effective length of said handle by a distance Δl;

an actuating element coupled to said carriage for moving said carriage by engagement with a user's thumb for movement of said carriage between said retracted and extended positions; and a blade mounted on said carriage for sharing the movements of said carriage and having an operative portion that can fully penetrate a work to be cut when said handle axis is inclined at an angle α relative to a surface of the work; wherein the handle includes a forward portion closest to the operative portion of the blade, the forward portion being configured for positioning a finger of a user so that a center axis of the finger is a distance h above the work surface when the operative portion of the blade fully penetrates the work to be cut, Δl and α being selected so that the distance h is equal to at least 1.0 inch.

2. Utility knife as claimed in claim 1, wherein Δl≥1.4 inches.

3. Utility knife as claimed in claim 2, where Δl≥1.5 inches.

4. Utility knife as claimed in claim 1, wherein $\Delta l \geq$ is within the range of 1.6 and 1.7 inches.

5. Utility knife as claimed in claim 1, wherein $\alpha$ is selected to be $\geq 35°$.

6. Utility knife as claimed in claim 5, wherein $\alpha$ is selected to be $\geq 48\text{-}50°$.

7. Utility knife as claimed in claim 6, wherein $\alpha \approx 45°$.

8. Utility knife as claimed in claim 1, wherein the actuating element comprises a button.

9. Utility knife as claimed in claim 1, wherein said forward portion is provided with one or more recesses arranged to at least partially receive the finger of the user to effectively increase the distance h.

10. Utility knife as claimed in claim 9, wherein said one or more recesses comprise a lower-most recess closest to said remote end of said handle and one or more upper recess, said lower-most recess being deeper than said one or more upper recesses.

11. Utility knife as claimed in claim 1, wherein said remote end of said handle has a guide edge for properly positioning said handle at said angle $\alpha$ when said guide edge is positioned coextensively with the work surface of the work.

12. Utility knife as claimed in claim 11, wherein said guide edge is inclined at said angle $\alpha$ relative to said handle axis.

13. Utility knife as claimed in claim 1, wherein said angle $\alpha$ is selected between angle 40-50°.

14. Utility knife as claimed in claim 13, wherein said angle $\alpha \approx 45°$.

15. Utility knife comprising:

a handle having a longitudinal axis A;

a utility blade; and a blade carriage configured to releasably hold the utility blade, wherein:

the blade carriage includes a forward end inclined at an angle $\alpha$ relative to axis A, the blade carriage is configured to slide between a retracted position, in which the utility blade is disposed in the handle, and a fully extended position, in which the forward end extends from the handle a distance L, the handle includes a forward portion closest to a cutting edge of the utility blade, the forward portion being configured for positioning a finger of a user, and when the utility blade is fully engaged in a work surface such that the forward end of the blade holder is flush with the work surface, the angle $\alpha$ and distance L are selected such that at least one point of the forward portion is a distance of at least 1 inch above the work surface.

16. Utility knife as claimed in claim 15, wherein the blade carriage is configured to slide parallel to axis A between the retracted position and the fully extended position.

17. Utility knife comprising:

a handle having a back end and a front end, the front end including a handle front edge;

a utility blade; and a blade carriage configured to releasably hold the utility blade and having a carriage front edge, wherein:

the blade carriage is configured to laterally slide relative to the handle between a retracted position in which the utility blade is disposed in the handle and a fully extended position in which the carriage front edge and the utility blade extend forward of the handle front edge, and when the blade carriage is in the fully extended position, the minimum distance between any point on the carriage front edge and any point on the handle front edge is at least 0.8 inches.

18. Utility knife as claimed in claim 9, wherein the recess is disposed on a forwardmost end of the forward portion such that the user's finger cannot be placed on the handle forward of the recess.

* * * * *